US005601037A

United States Patent [19]

Meyer et al.

[11] Patent Number: 5,601,037

[45] Date of Patent: Feb. 11, 1997

[54] TABLE WITH RECESSED HEIGHT-ADJUSTING CRANK

[75] Inventors: Kevin L. Meyer, Hudsonville; David F. Lyons, Grosse Pointe Farms, both of Mich.; Jorge Q. Davies; George J. Simoni, both of Hanworth, England; Roberto G. Fraquelli, London, England

[73] Assignee: Haworth, Inc., Holland, Mich.

[21] Appl. No.: 528,436

[22] Filed: Sep. 14, 1995

Related U.S. Application Data

[63] Continuation-in-part of Ser. No. 489,083, Jun. 9, 1995, abandoned.

[51] Int. Cl.[6] ..... A47B 9/00

[52] U.S. Cl. ..... 108/147; 108/144

[58] Field of Search ..... 108/147, 144; 248/188.2, 188.4, 188.5, 188.1

[56] References Cited

U.S. PATENT DOCUMENTS

| | | | |
|---|---|---|---|
| 2,165,060 | 7/1939 | Krug . | |
| 2,808,303 | 10/1957 | Frank | 108/147 |
| 3,044,478 | 7/1962 | Russell . | |
| 3,383,945 | 5/1968 | Carella . | |
| 3,967,511 | 7/1976 | Breitschwerdt . | |
| 4,023,858 | 5/1977 | Bienert et al. . | |
| 4,222,602 | 9/1980 | Kouth . | |
| 4,487,558 | 12/1984 | Troutner . | |
| 4,627,364 | 12/1986 | Klein et al. | 108/147 |
| 4,811,623 | 3/1989 | Tomiser, Jr. . | |
| 5,230,290 | 7/1993 | Crossman | 108/147 X |

FOREIGN PATENT DOCUMENTS

| | | | |
|---|---|---|---|
| 355451 | 2/1990 | European Pat. Off. | 108/147 |
| 379262 | 7/1990 | European Pat. Off. | 108/147 |

OTHER PUBLICATIONS

"The Teknion Office System—TeknionTwo—Panel System and Desk System" brochure, Teknion Furniture Systems, (8 pages).

Haworth "Furniture That Works—Office Desking System" brochure, Haworth, Inc., 1994 (4 pages).

Steelcase "Ellipse Desk System" Product Overview brochure, Steelcase Inc., 1994, (22 pages).

Steelcase "Ellipse Desk System" Product Overview appearance performance brochure, Steelcase Inc., (14 pages).

Steelcase Inc. "The art of working brings you . . . unlimited possibilities" Ellipse brochure, (11 pages).

Various pages (8 pages) from Krueger Price List Guide for various "WorkZone" products.

Herman Miller "Newhouse Group Furniture" brochure, Herman Miller, Inc., 1988, (12 pages).

Herman Miller "Newhouse Group Furniture" Planning Information brochure, Herman Miller, Inc., 1988, (62 pages).

*Primary Examiner*—Jose V. Chen

*Attorney, Agent, or Firm*—Flynn, Thiel, Boutell & Tanis, P.C.

[57] ABSTRACT

A freestanding table having a worksurface supported on height-adjustable legs, each having a height-adjusting mechanism. These mechanisms are simultaneously driven through a driving element such as an endless chain driven by a driving sprocket disposed adjacent the underside of the worksurface. The driving sprocket is nonrotatably connected to a rotatable hub supported in a recess in the worksurface, which recess also accommodates a foldable crank. The crank when in a folded and stored position is disposed in the recess so as to be substantially flush with the upper surface of the worksurface. The crank is pivotally joined about a first axis to an intermediate link which in turn is pivotally joined about a second axis to a rotatable hub so that the crank can be pivoted upwardly through an angle of about 180° so as to be disposed above the worksurface to permit manual gripping and hence rotation thereof when height adjustment is desired.

21 Claims, 7 Drawing Sheets

TABLE WITH RECESSED HEIGHT-ADJUSTING CRANK

CROSS REFERENCE TO RELATED APPLICATION

This is a continuation-in-part of our application Ser. No. 08/489 083 , filed Jun. 9, 1995 (Atty Ref: Haworth Case 183) now abandoned, and entitled "TABLE WITH RECESSED HEIGHT-ADJUSTING CRANK".

FIELD OF THE INVENTION

This invention relates to a freestanding desk or table having an improved manually-actuated height-adjusting arrangement associated therewith.

BACKGROUND OF THE INVENTION

Numerous freestanding desks or tables as utilized in offices and educational environments are provided with height-adjustment capability, including use of mechanisms which employ a manually-actuated rotatable crank for activating a drive element such as a drive shaft or flexible element which in turn cooperates with height-adjusting units associated with the legs. In many of the known height-adjusting arrangements, the crank is often supported for connection to a driving member at a position under the worksurface, whereby the operator must access the crank to effect rotation thereof, and often times accessing the crank is difficult or inconvenient because of its location under the worksurface.

In other known desks or tables, attempts have been made to overcome the above disadvantage by providing a drive member which projects up and is accessible from above the worksurface. Such arrangements have typically provided a drive hub at or above the worksurface, and in such case a removable crank is provided which must be separately stored, then engaged with the drive hub when height adjustment is desired, and then removed and restored. Such arrangement has also proven undesirable, however, in that provision of a separate and removable crank is inconvenient since often times there is no convenient place to store the crank, so that the crank can be easily misplaced and this thus makes height adjustment inconvenient due to the necessity of having to continually retrieve the crank from storage for use, and then restore the crank.

It is an object of this invention to provide a freestanding height-adjustable table or desk having a height-adjusting mechanism which employs a manually activated crank, which crank can be accessed and operated from a location above the worksurface, but which can be folded and stored in a recess which is substantially flush with the upper surface of the worksurface, whereby the crank remains permanently connected to the drive arrangement at all times.

In the freestanding desk or table of this invention, the worksurface is supported on height-adjustable legs, each having a height-adjusting mechanism which in the preferred embodiment comprises an extendable and contractible screw unit. The screw units associated with the legs are simultaneously driven through a driving element such as an endless chain which is driven by a driving sprocket disposed adjacent the underside of the worksurface. The driving sprocket is nonrotatably connected to a rotatable hub which is supported in a recess in the worksurface, which recess also accommodates a foldable crank. The crank when in a folded and stored position is disposed in the recess so as to be substantially flush with the upper surface of the worksurface. The crank can be pivoted upwardly about a first axis and is pivotally joined about the first axis to an intermediate link which in turn pivots about a second axis to a rotatable hub so that the crank can be pivoted upwardly through an angle of about 180° so as to be disposed above the worksurface to permit manual gripping and hence rotation thereof when height adjustment is desired.

Other objects and purposes of the invention will be apparent to persons familiar with structures of this general type upon reading the following specification and inspecting the accompanying drawings.

Figure 1:
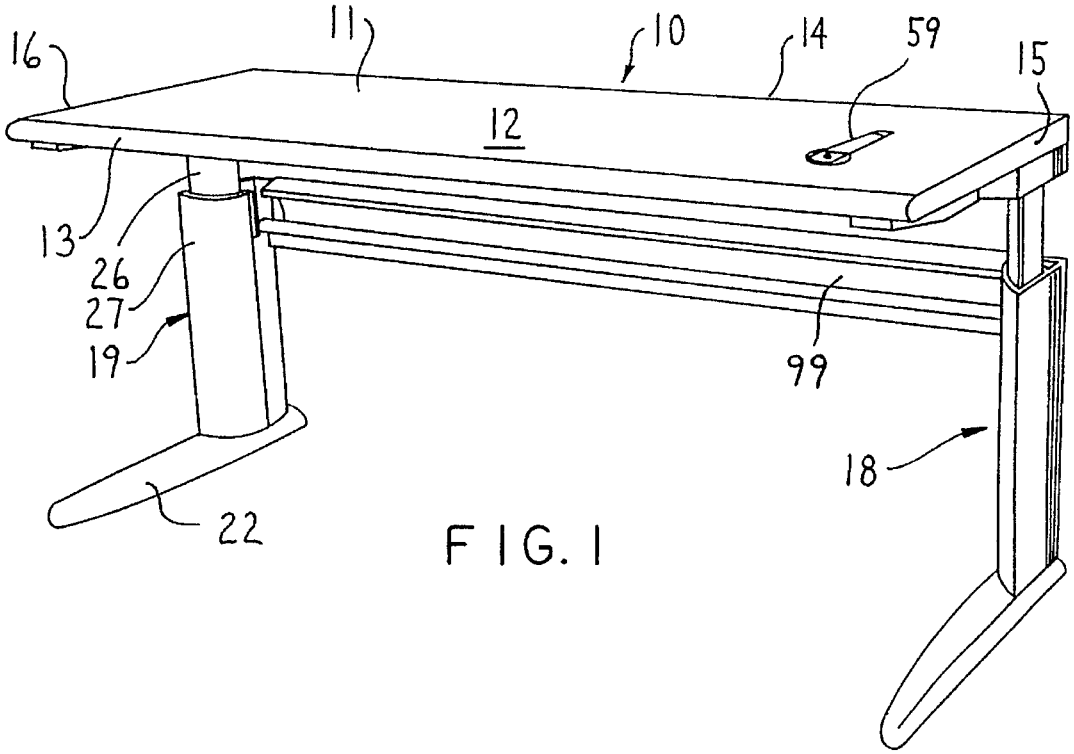
FIG. 1 is a perspective view of a desk incorporating the improved height-adjusting arrangement of this invention.

Certain terminology will be used in the following description for convenience in reference only, and will not be limiting. For example, the words "upwardly", "downwardly", "rightwardly" and "leftwardly" will refer to directions in the drawings to which reference is made. The words "upwardly" and "downwardly" will also refer to the normal geometric positional relationships associated with the desk when in a position of use. The words "inwardly" and "outwardly" will refer to directions toward and away from, respectively, the geometric center of the desk and designated parts thereof. Said terminology will include the words specifically mentioned, derivatives thereof, and words of similar import.

DETAILED DESCRIPTION

Figure 2:
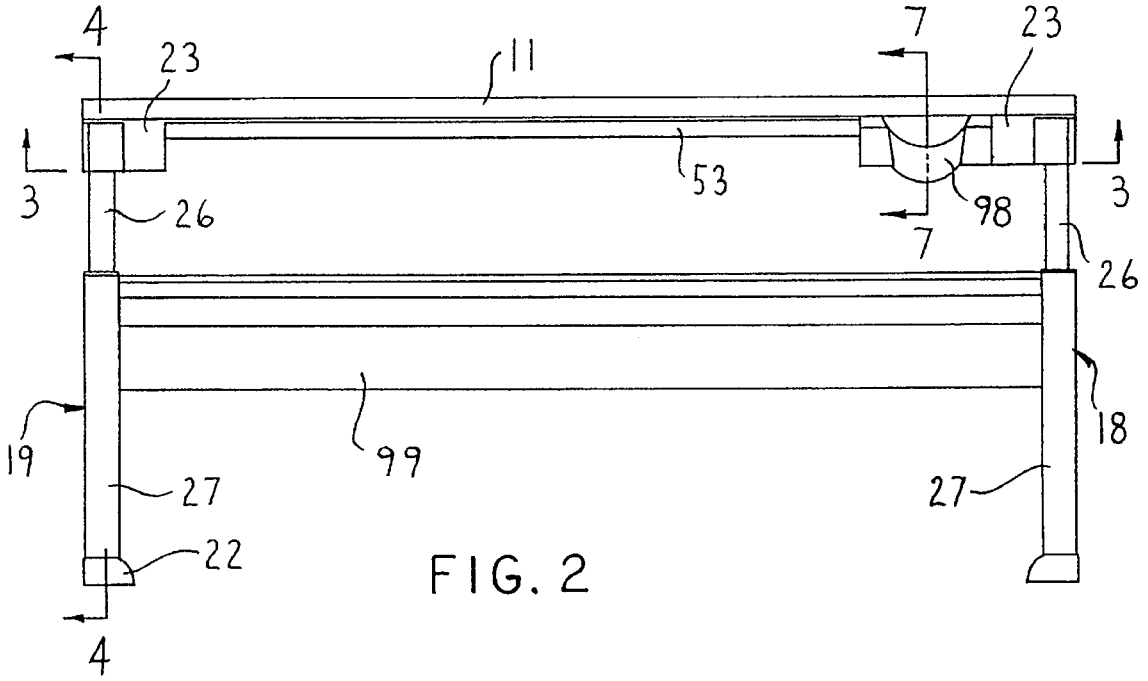
FIG. 2 is a front elevational view thereof.
Figure 3:
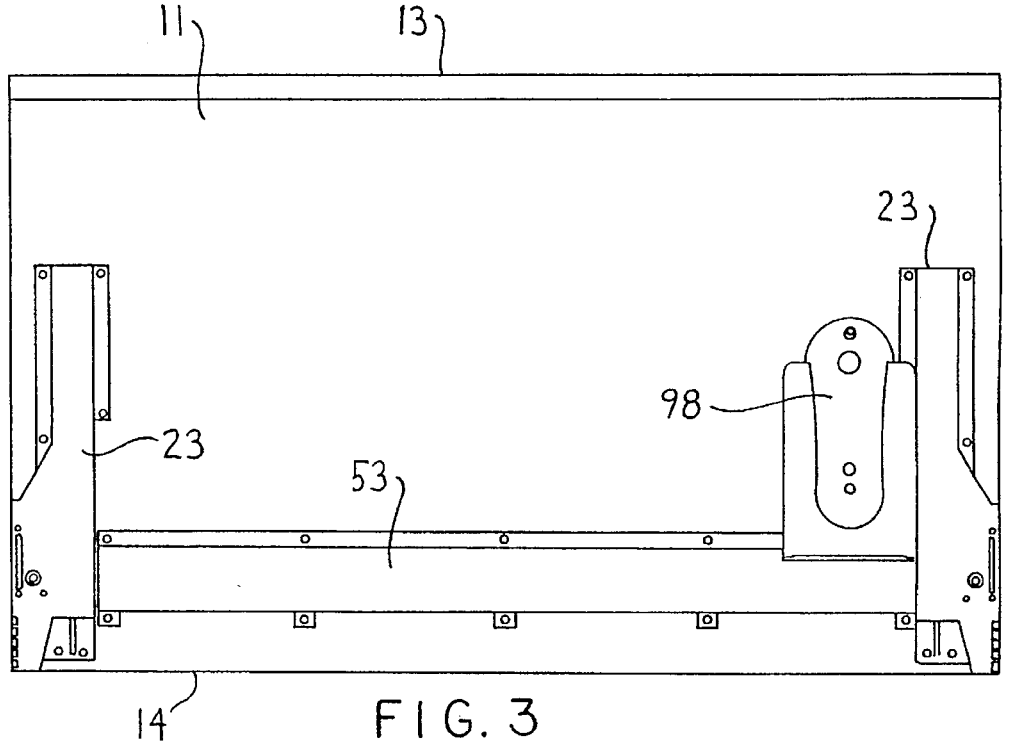
FIG. 3 is a bottom view of the worksurface with the legs of the table removed, this view being taken generally along line 3—3 in FIG. 2.

Referring to FIGS. 1–3, there is illustrated a desk or table 10 according to the present invention. This desk includes a horizontally enlarged top or worksurface 11 defining thereon a horizontally enlarged and planar upper surface 12. The worksurface 11 has, in the illustrated embodiment, substantially parallel and longitudinally extending front and rear edges 13 and 14, respectively, joined by transversely extending side or end edges 15 and 16. The worksurface is supported, adjacent opposite ends thereof, by downwardly projecting leg assemblies 18 and 19, the latter being substantially identical except for being mirror images of one another.

Figure 4:
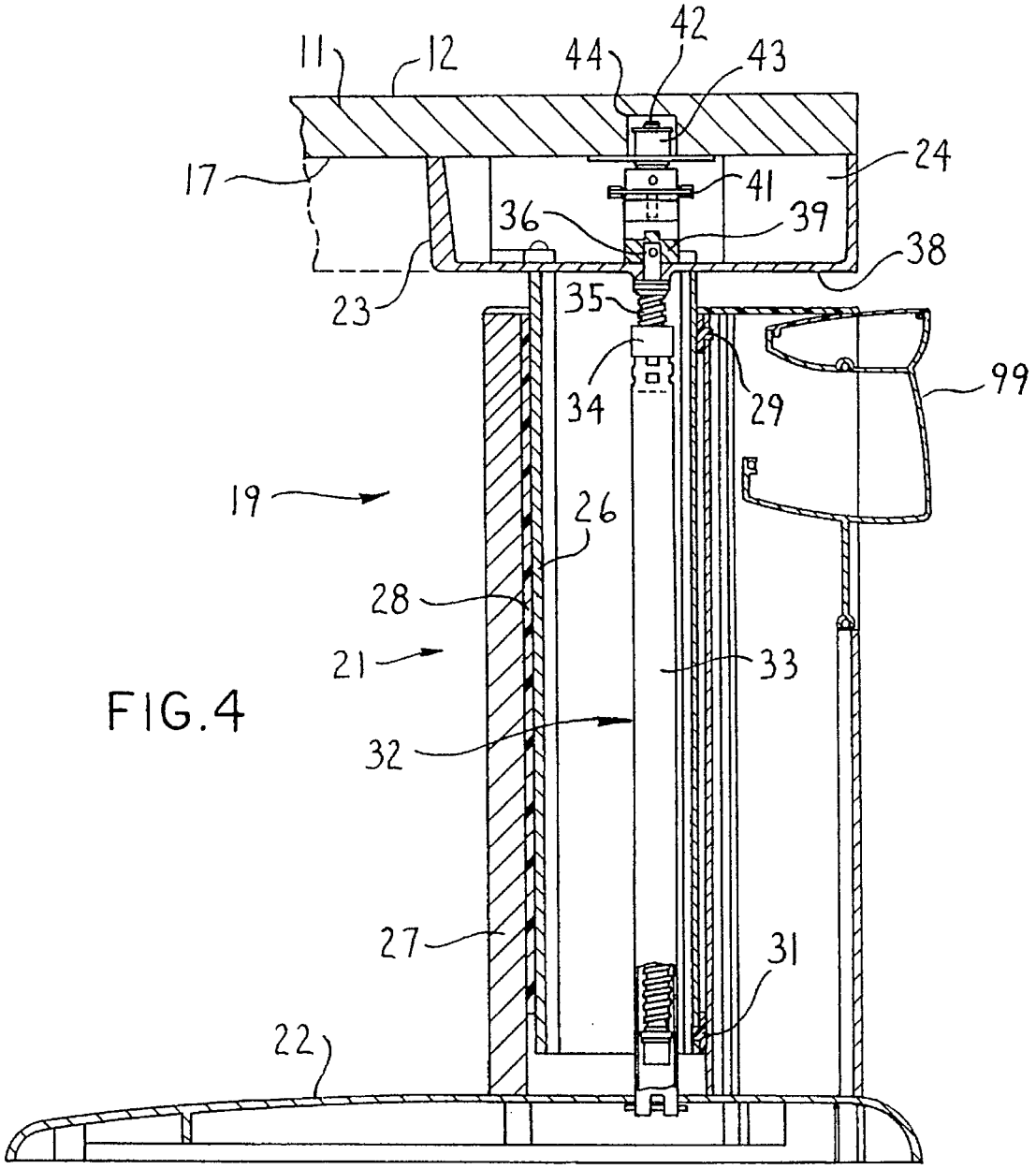
FIG. 4 is an enlarged fragmentary sectional view of the leg assembly as taken generally along line 4—4 in FIG. 2.
Figure 5:
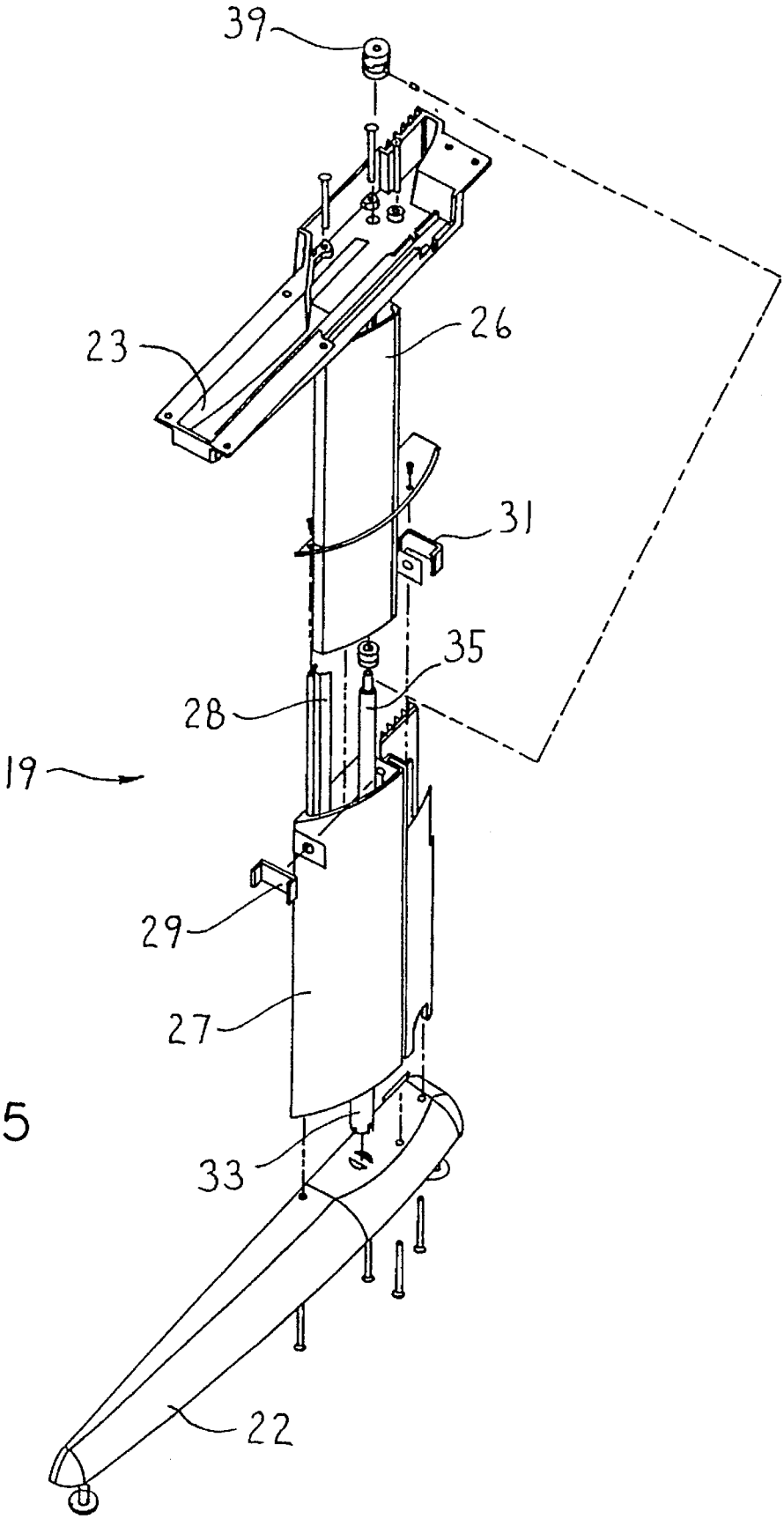
FIG. 5 is an exploded perspective view of the leg assembly shown in FIG. 4.

Each leg assembly, as illustrated by FIGS. 4 and 5, includes a upright height-adjustable leg 21 which at a lower end is joined to a horizontally elongate foot 22 adapted for supportive engagement with a floor. The leg 21 at its upper end joins to a horizontally elongate support arm 23 which is disposed for supportive engagement with the bottom surface 17 of the worksurface 11 adjacent a respective end edge thereof. This support arm 23 has a channel-like configuration which defines therein an interior space 24, whereby the support arm 23 additionally functions as a shroud for enclosing components of the height-adjusting mechanism.

The height-adjustable leg 21 includes respective upper and lower leg members 26 and 27 which vertically slidably telescope one within the other. These leg members in the illustrated embodiment are both vertically elongate hollow tubular elements of similar cross sectional configuration, and the upper leg member 26 has the upper end thereof rigidly joined to the respective support arm 23. This upper leg member 26 is vertically cantilevered downwardly so as to slidably project into the upper end of the lower leg member 27, the latter having the lower end thereof fixedly secured to the respective foot 22 so that this lower leg member 27 is cantilevered upwardly therefrom.

The lower leg member 27 has a vertically elongate slide guide or bearing 28 secured along the front inside thereof for slidable engagement with the front of the upper leg member 26. A small slide pad 29 is fixed to the upper end of the lower leg member 27 adjacent the other side of the opening thereof for slidable engagement with the rear side of the upper leg member 26. In similar fashion the lower end of the upper leg member 26, on the rear side thereof, is provided with a slide pad 31 adapted for slidable engagement with the inside surface of the lower leg member 27.

The height-adjustable leg 21 includes a height-adjusting mechanism 32 disposed interiorly thereof and projecting vertically therealong. This height-adjusting mechanism 32 in the illustrated embodiment comprises an extendable and contractible screw unit, preferably an Acme-type screw unit, having a vertically elongate sleevelike housing part 33 which has the lower end thereof fixed relative to the lower leg member 27, such as by being fixed to the foot 22. This housing part 33 projects vertically upwardly through the interior of the lower leg member 27 and the housing part 33 has an internally threaded nut 34 associated therewith, which nut is in the vicinity of the upper free end of the lower leg member 27. This stationary nut 34 has a vertically elongate and rotatable screw shaft 36 threadedly engaged therewith and project therethrough into the interior of the sleevelike housing 33. This screw shaft 36 has an upwardly projecting stub shaft part 37 which is rotatably supported on and projects through a suitable opening formed in the bottom wall 38 of the respective support arm 23. This stub shaft 37 at its upper end is nonrotatably secured to the lower half of a rotatable coupling 39 which is disposed within the chamber 24 of the support arm 23. This coupling 39 may comprise a conventional Oldham coupling, and the upper part thereof is nonrotatably joined to the lower axial end of a driven sprocket 41.

The driven sprocket 41 is supported directly below the worksurface 11 and is rotatable about an axis which extends generally perpendicular (i.e, vertical) relative to the worksurface. For this purpose, sprocket 41 has an upwardly projecting hub 42 which is rotatably supported within a bearing unit 43 which is fixed relative to the worksurface and is accommodated within a bore 44 which opens upwardly from the underside 17 of the worksurface.

Figure 6:
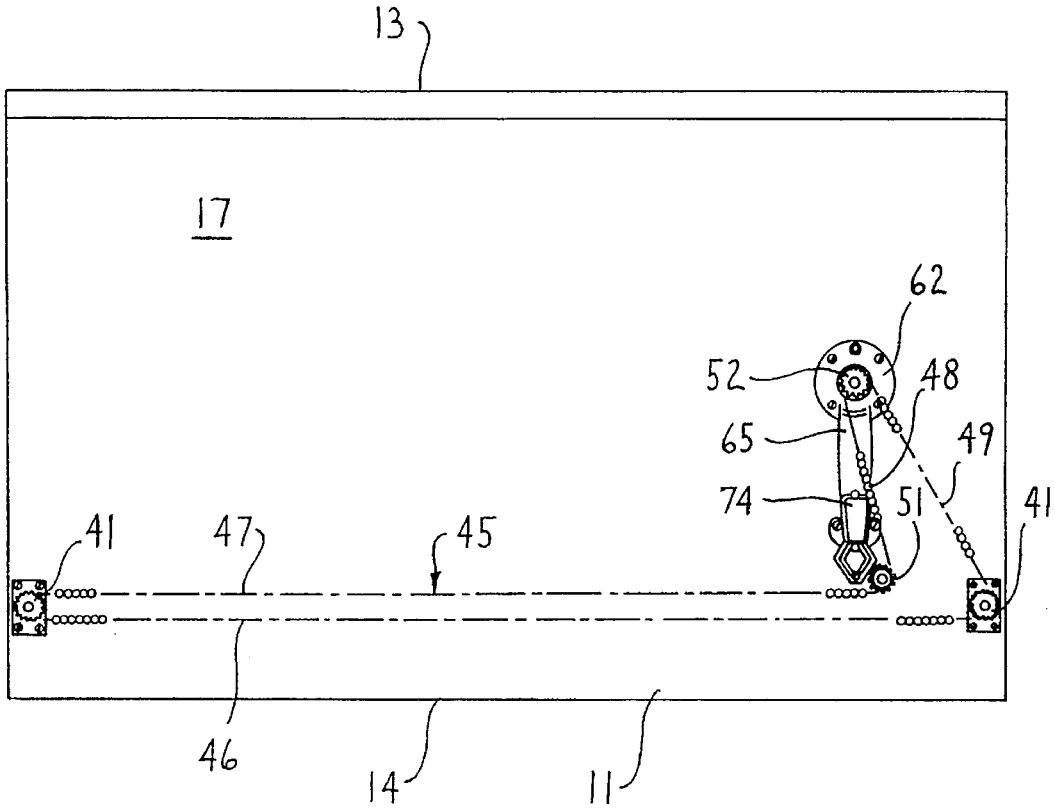
FIG. 6 is a bottom view of the worksurface similar to FIG. 3 but with the shrouds removed so as to show the sprocket and chain drive arrangement.

As illustrated by FIG. 6, an elongate drive element formed specifically as an endless chain 45 is engaged with the two drive sprockets 41 associated with the height-adjusting units of the leg assemblies 18 and 19. These sprockets 41 are thus disposed in close proximity to the underside of the worksurface adjacent the opposite end edges thereof. The chain 45 includes a rear reach 46 which extends longitudinally under the worksurface directly between the two sprockets 41, with the chain wrapping around the leftmost sprocket 41 in FIG. 6 so that the chain includes a front reach 47 which then extends longitudinally along the underside of the worksurface for engagement with a tensioning idler sprocket 51 which is rotatably supported on the underside of the worksurface. The chain 45 passes around the idler sprocket 51 and includes a chain reach 48 which then projects forwardly toward the front edge of the table so as to pass around a driving sprocket 52, with the chain after passing around the driving sprocket 52 including a further reach 49 which extends rearwardly and passes around the adjacent driven sprocket 41.

The chain 45 and specifically the reaches 46 and 47 thereof are suitably enclosed by a longitudinally elongate channel-like shroud 53 which is secured to the underside of the worksurface.

To control the rotation of the driving sprocket 52, the table of the present invention is provided with a manually-actuated crank arrangement which is drivingly joined to the sprocket 52. For this purpose, the worksurface 11 has a horizontally-elongated opening 56 which extends vertically therethrough between the upper and lower surfaces thereof, this opening in horizontal cross section being of a keyhole-shaped configuration and spaced inwardly from all of the edges of the worksurface. The opening 56 mounts therein a housing 57 which, in horizontal cross section, also has a generally keyhole-shaped outside configuration so as to be stationarily and snugly accommodated within the opening 56 formed through the worksurface. This housing 57 in turn pivotally and rotatably supports a crank assembly 59 thereon.

Figure 7:
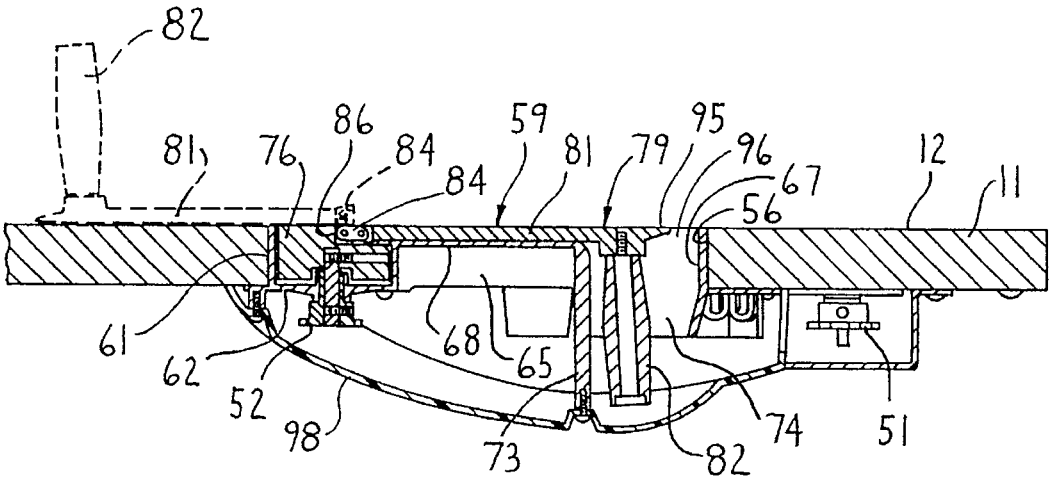
FIG. 7 is an enlarged sectional view taken generally along line 7—7 in FIG. 2 and showing the crank arrangement in the folded and stored position.
Figure 9:
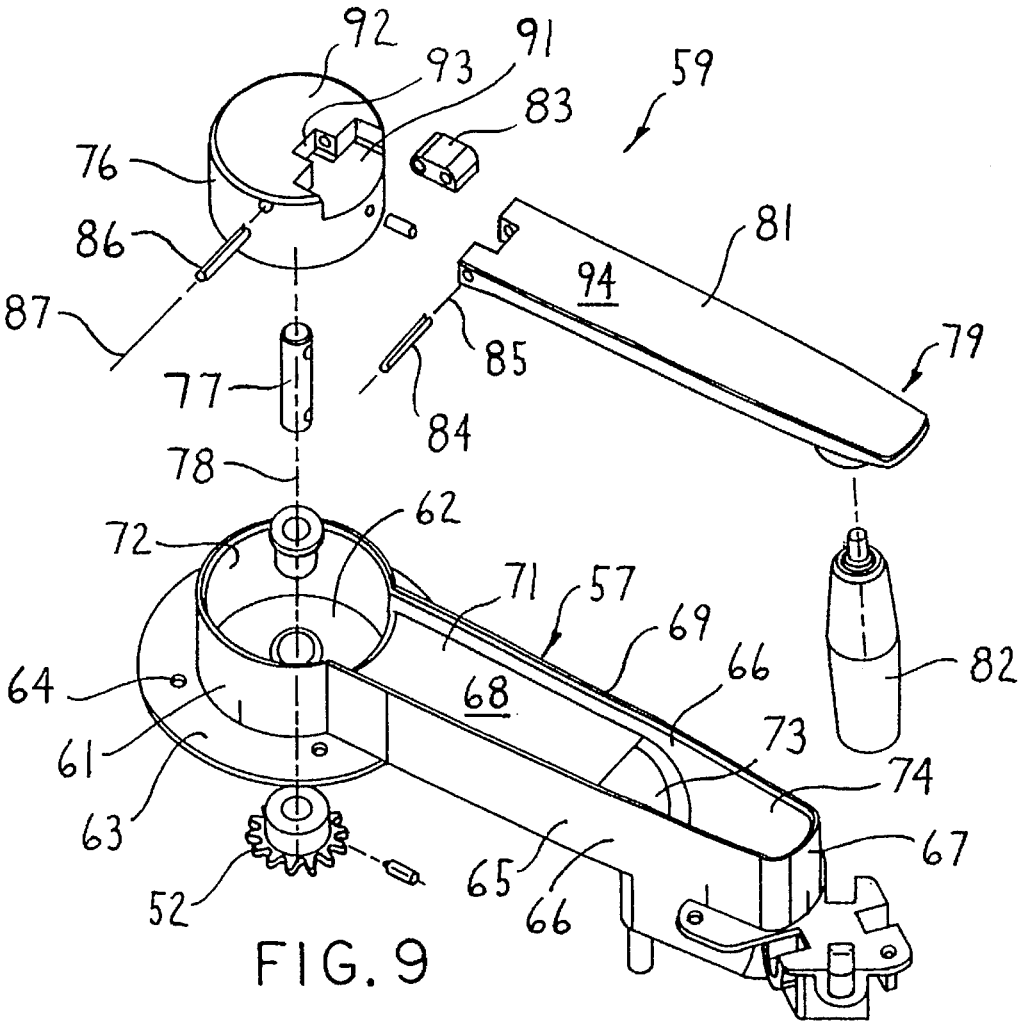
FIG.9 is an enlarged exploded perspective view of the crank and the support housing therefor which is accommodated within the worksurface.
Figure 8:
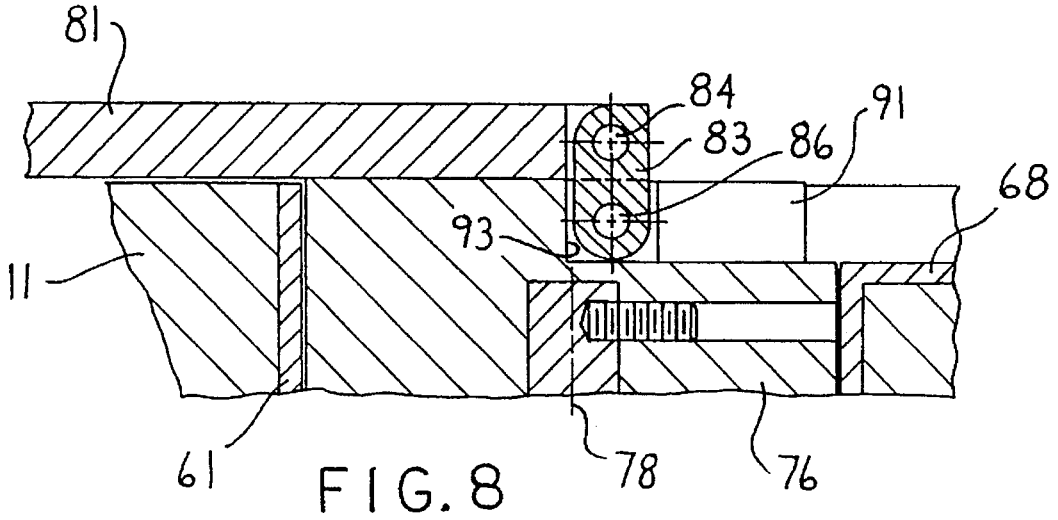
FIG. 8 is a fragmentary and enlarged sectional view of a portion of FIG. 7 and showing the crank in the raised operable position.

The housing 57, as shown by FIGS. 7–9, has a generally hollow cylindrical hub 61 formed at one end thereof, which hub has a bottom wall 62 extending transversely thereof, which wall includes a radially outwardly projecting bottom flange 63 adapted to overlie the adjacent bottom surface 17 of the worksurface. This flange has suitable openings 64 therethrough for accommodating fasteners such as screws to permit fixed attachment of the housing 57 to the worksurface.

Housing 57 has a horizontally elongate channel part 65 which is fixed to and projects radially outwardly from one side of the hollow cylindrical hub 61. In the illustrated embodiment, this channel part 65 projects from the hub 61 in a direction toward the front edge of the worksurface. The channel part 65 is defined by approximately parallel upright side walls 66 which at their outer ends are joined by an end wall 67. A base wall or web 68 is fixed to and projects radially outwardly from the hub 61, with this web 68 extending transversely between and being joined to the opposed side walls 66 in slightly downwardly spaced relation from the upper edge 69 of the housing 57. This web 68, in conjunction with the side walls 66, defines a shallow channel 71 thereabove, which channel is recessed downwardly from the upper surface 12 of the worksurface 11. In this regard, the upper edge 69 of the housing 57 is substantially flush with the upper surface 12. The shallow channel 61 also opens through the hollow cylindrical hub 61 for direct communication with the cylindrical space or pocket 72 defined therein.

The web 68, at a location remote from the hollow hub 61, terminates at a downwardly depending wall 73, the latter being disposed in opposed but spaced relation from the end wall 67 so as to define an unobstructed passage or opening 74 which projects downwardly through the worksurface.

The hollow hub 61 rotatably supports therein a cylindrical support or bearing 76 which has a stub shaft 77 coaxially fixed thereto and projecting downwardly through an opening in the bottom wall 63 for nonrotatable and coaxial connection to the driving sprocket 52. This cylindrical bearing 76 and shaft 77, along with the driving sprocket 52, are rotatable about an axis 78 which extends perpendicular with respect to the upper surface 12, and more specifically this axis 78 extends vertically.

The crank assembly 59 includes a L-shaped crank 79 which is joined to the cylindrical bearing 76 to effect rotation thereof. This crank 79 includes a radially elongate crank arm 81 which at its outer end has a crank handle 82 fixed thereto, which crank handle 82 projects generally perpendicularly with respect to the radial or elongated direction of the crank arm 81. The crank handle 82 is adjacent the free end of the crank arm 81, and this crank arm at its other or inner end is pivotally interconnected to an intermediate connecting link 83 by means of a first hinge pin 84 which defines a generally horizontal hinge axis 85. This intermediate connecting link 83 in turn is pivotally joined by a second generally horizontally extending hinge pin 86, which defines a horizontal hinge axis 87, to the cylindrical bearing 76. The hinge axes 85 and 87 are generally parallel and transversely spaced a small distance apart, with these horizontal axes 85 and 87 extending generally perpendicularly with respect to the radial or elongate direction of the crank arm 81.

The cylindrical bearing 76 has a generally rectangular recess or cutout 91 which opens inwardly from the cylindrical periphery thereof, with this recess 91 opening upwardly through the upper surface 92 of the bearing. This recess 92, at its rear end, communicates with a further cutout or recess 93 which is of reduced width and projects into the center region of the bearing 76. The recess 93, as illustrated by FIGS. 7 and 9, accommodates therein the inner bifurcated end of the crank arm 81, and the slot in the bifurcated end of the crank arm 81 accommodates one end of the intermediate connecting link 83 therein, which connecting link projects outwardly so that the other end thereof is disposed within the small cutout or recess 93. The hinge pin 86 which is mounted on the cylindrical bearing 76 projects across this cutout 93 so as to pivotally join to the inner end of the intermediate connecting link 83.

When the crank arm 81 is in the storage position so that it projects along the shallow channel 71 and bears against the web 68, the crank arm 81 is provided with a flat surface 94 which faces upwardly and is substantially flush with the upper surface 12 of the worksurface 11. The crank arm 81 also has an extension or tab part 95 which projects radially beyond the handle 82 in a direction toward the end wall 67, this tab part 95 being sufficiently spaced from the end wall 67 by a clearance space or slot 96 therebetween to facilitate insertion of an operator's fingers through the clearance slot so as to engage the underside of the tab part 95. As indicated by FIG. 7, when in the storage position, the handle 82 projects downwardly through the opening 74. The underside of the worksurface has a suitably shaped shroud 98 fixed thereto, which shroud encloses the underside of the housing 67 and the crank, as well as the driving sprocket 52.

When the desk is at a selected height, the crank arrangement will be disposed in the stored position illustrated by FIG. 7, in which position the crank is disposed within a recess formed in the worksurface so that the upper surface or profile of the crank is substantially flush with the upper surface 12 so as to not interfere with efficient usage thereof. At the same time, however, the crank remains permanent drivingly interconnected to the driving sprocket 52. When in this stored position, the arm 81 of the crank effectively bears against the web 68, and the handle 82 projects downwardly through the opening 74. In this position, the crank arm 81 and the intermediate connecting link 83 are substantially longitudinally aligned with one another and project radially relative to the rotational axis of the support bearing 76, with all of these parts, namely the support bearing 76, connecting link 83 and crank arm 81, all having upper surfaces which are substantially flush with the upper surface 12.

When height adjustment of the worksurface 11 is desired, the operator inserts his/her fingers through the clearance 96, grasps the underside of the tab 95, and swings the crank 79 upwardly about the pivot 84. After the crank has been swung upwardly about 90° into a substantially upright position about the pivot 84, further rearward (counterclockwise) swinging of the crank causes the connecting link 83 to hinge upwardly about the hinge axis 87 into a substantially upright position as illustrated by FIG. 8, in which position the crank arm 81 again projects radially relative to the cylindrical bearing 76 but is now disposed so as to be positioned closely adjacent but above the upper surface 12, whereupon the crank handle 82 now projects upwardly as indicated by dotted lines in FIG. 7. The flat side surface 94 of the crank 81 effectively bears against or is disposed in opposed and closely adjacent relationship to the upper surface of the cylindrical bearing 76.

When in the raised or use position illustrated by dotted line in FIG. 7, the operator can manually grip the handle 82, and then effect rotation thereof about the axis 78. This causes a corresponding rotation of the cylindrical bearing 76, and in turn rotation of the driving sprocket 52. This in turn drives the chain 45, causing simultaneous and corresponding rotation of the driven sprockets 41 associated with the two leg assemblies, thereby causing the height-adjusting screw units to simultaneously extend or retract, depending upon the direction of rotation, so as to move the worksurface 11 to the desired height.

When the desired height of the worksurface has been reached, rotation of the crank is stopped, and the self locking aspects of the Acme screw type height-adjusting units will automatically maintain the worksurface in the selected height. The crank is then manually swung vertically upwardly through an angle of 180° so as to cause the crank arrangement to resume the recessed stored position illustrated by solid lines in FIG. 7.

Figure 10:
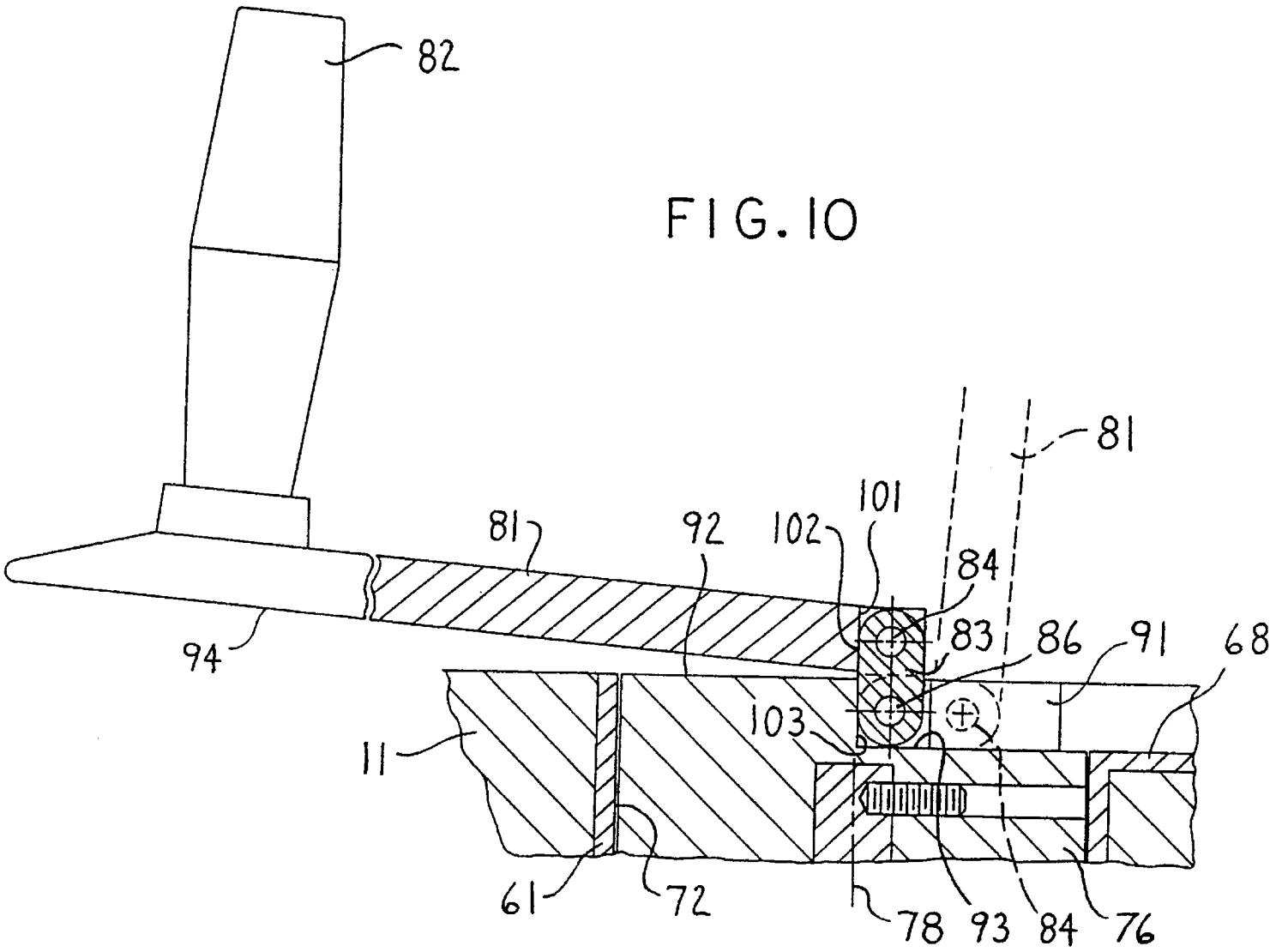
FIG. 10 is a fragmentary and enlarged sectional view showing in greater detail a preferred construction of the crank.

The crank arrangement preferably has stops associated therewith which, when the crank is swung into the use position illustrated by solid lines in FIG. 10, maintain the crank in slightly upwardly spaced relation from the upper surface of the worksurface. For this purpose, the bifurcated end of the crank arm 81 has an end wall 101 which defines the slot which accommodates the end of the connecting link 83 therein, which end wall 101 preferably extends at a slight angle, such as between about 3° to about 5°, relative to a plane perpendicular to the longitudinal direction of the crank. This angle of the end wall 101 slopes inwardly toward the connecting link as it projects upwardly when the crank is in the stored position. Accordingly, when the crank arm 81 is swung vertically upwardly away from its storage position toward an upright vertical position, the stop surface 101 abuts against a flat side surface 102 of the connecting link 83, such being indicated by the dotted-line position of the crank 81. In this illustration, the crank 81 approaches a vertical orientation but is generally slightly angled therefrom, such as by an angle of about 3° to about 5°. Further vertical swinging of the crank 81 away from the dotted position of FIG. 10 now causes the crank arrangement to hinge about the hinge pin 86 so that the connecting link 83 swings upwardly so as to project upwardly above the upper surface of the worksurface 11, with the crank 81 maintaining a fixed angular orientation with the connecting link 83 due to the abutment between the surfaces 101 and 102. After the connecting link 83 has been swung upwardly about 90° about the hinge 86, the flat surface 102 thereof effectively abuts against a rear surface 103 of the recess 93, which rear surface 103 functions as a stop surface and results in the crank arrangement being disposed in an operative position substantially as illustrated by solid lines in FIG. 10. In this operative position, the crank arm 81 projects radially away from the cylindrical bearing 76 in an approximately horizontal orientation with the crank 81 being disposed closely adjacent but above the upper surface of the worksurface 11. The cooperation between the surfaces 101 and 102, coupled with the cooperation between the surfaces 102 and 103, however, cause the crank 81 to be angled slightly upwardly at a small angle, typically between about 3° and about 5°, so that the crank hence does not contact or rub against the upper surface of the worksurface. This thus facilitates manual gripping of the handle 82 and rotation of the crank arrangement so as to permit desired raising or lowering of the worksurface.

The table 10 as illustrated in FIGS. 1 and 2 has a cable-accommodating trough or channel 99 extending horizontally between and fixedly connected to the lower leg members 27. This cable trough 99 accommodates therein electrical power and/or telecommunication cables so as to facilitate access and connection thereto from suitable equipment, such as computers or the like, positioned on the worksurface.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright freestanding table having a horizontally enlarged worksurface having enlarged upper and lower surfaces, and a pair of leg assemblies fixed to and projecting downwardly from the worksurface adjacent opposite end edges thereof for supportive engagement with a floor, each leg assembly including vertically elongate upper and lower leg members which vertically telescope one within the other, a height-adjusting mechanism extending vertically of and interconnected between the respective upper and lower leg members for permitting selective height adjustment of the upper leg member relative to the lower leg member, and a drive arrangement drivingly connected to the height-adjusting mechanisms of the leg assemblies for permitting simultaneous height adjustment thereof, said drive arrangement including a rotatable driven member associated with each height-adjusting mechanism at a location disposed adjacent the lower surface of the worksurface, said drive arrangement also including an intermediate drive member drivingly connected to said driven members and a rotatable driving member disposed adjacent the lower surface of the worksurface and disposed in driving engagement with said intermediate drive member, and a manually-activated crank arrangement rotatably drivingly connected to said driving member, the improvement wherein said crank arrangement comprises:

a horizontally-elongated recess formed in said worksurface and opening upwardly through the upper surface thereof, said recess defining a generally cylindrical pocket at one end thereof which opens downwardly from said upper surface, said recess at the other end defining a passage which extends transversely through the worksurface between the upper and lower surfaces thereof;

a support member rotatably disposed within said pocket for rotation relative to said worksurface about a main axis which extends substantially perpendicularly with respect to said upper surface, means fixed to said worksurface for rotatably supporting said support member so that said support member is positioned in its entirety substantially at or below said upper surface, said support member having a shaft part which projects downwardly along said main axis and is coaxially and nonrotatably connected to said driving member;

a generally L-shaped crank for interconnection to said support member to permit rotation thereof about said main axis, said crank including an elongate crank arm which adjacent an outer free end thereof is provided with a handle fixed thereto and extending transversely therefrom, said handle being adapted to be manually gripped; and pivotal interconnecting means connected between said support member and said crank arm adjacent an inner end thereof for permitting the crank arm to be swingably moved generally within a vertical plane between a storage position and a use position, said L-shaped crank when in said storage position being disposed with the crank arm extending horizontally along and within the recess so that a top surface of the crank arm is substantially flush with said upper surface and said handle projects vertically downwardly through said passage, said L-shaped crank when in said use position being disposed entirely above said upper surface with said crank arm projecting approximately horizontally and radially away from said support member and said handle projecting upwardly from said crank arm.

2. A table according to claim 1, wherein said pivotal interconnecting means includes an intermediate link having a first pivotal connection with the inner end of said crank arm and a second pivotal connection with the support member, said first and second pivotal connections respectively defining first and second substantially horizontally extending pivot axes which are transversely spaced apart in generally parallel relationship.

3. The table according to claim 2, wherein said intermediate link is rotatable about said second pivotal axis through an angle of about 90° when said crank arm moves from said storage position to said use position and vice versa.

4. A table according to claim 2, wherein said intermediate link and said crank arm are both disposed within said recess and project horizontally in generally aligned relationship when the L-shaped crank is in said storage position, said intermediate link also being disposed so as to not project upwardly above said upper surface when in said storage position, said intermediate link projecting generally vertically upwardly above said upper surface in generally perpendicular relation thereto when said L-shaped crank is in said use position, and said crank arm projecting approximately horizontally in transverse relationship away from said intermediate link when in said use position, said first pivot axis being respectively disposed below and above the upper surface when the L-shaped crank is in the storage and use positions.

5. The table according to claim 4, wherein said crank arm has a stop means opposite said outer free end for holding said crank arm slightly upwardly-spaced above said upper surface of said worksurface so as to not contact said upper surface when said crank is in said use position.

6. The table according to claim 5, wherein a said crank arm in said use position is inclined relative to said upper surface at an angle between about 3° and about 5°.

7. A table according to claim 1, wherein the recess includes a horizontally elongate, vertically shallow channel part which opens upwardly through said upper surface and extends between and communicates at opposite ends thereof with said pocket and said passage, said shallow channel part being defined by a bottom wall which is spaced vertically downwardly a small distance from said upper surface, and said crank arm being disposed within and extending longitudinally along said shallow channel part when the crank is in the storage position.

8. A table according to claim 7, wherein said recess when viewed in the upper surface of said worksurface has a keyhole-shaped profile.

9. A table according to claim 1, wherein said horizontally-elongated recess opens transversely through said worksurface between the upper and lower surfaces thereof throughout the entire horizontal extent thereof, and said means for rotatably supporting said support member includes a support housing disposed within said recess and fixedly secured to said worksurface, said support housing having an outer peripheral wall with a horizontal configuration corresponding to the horizontal configuration of said recess so as to substantially totally occupy said recess, said housing having an upper edge which is substantially flush with said upper surface so that said housing in its entirety is disposed at and below said upper surface;

said housing at one end having a generally upwardly-opening cup-shaped part which defines said cylindrical pocket, said cup-shaped part having a base wall spaced downwardly from said upper surface and provided with an opening-projecting centrally therethrough for permitting downward projection of said shaft part, the peripheral wall of said housing having approximately parallel upright side walls which project away from said cup-shaped part toward the other end of said recess, the housing including a generally horizontally extending bottom wall which extends transversely and is joined between said upright side walls so as to cooperate therewith and define a horizontally elongate shallow channel which opens upwardly through the upper surface, said bottom wall being spaced vertically downwardly a small distance from the upper surface but disposed at an elevation above the base wall of the cup-shaped part, said bottom wall terminating at an end remote from said cup-shaped part and being joined to a vertically downwardly projecting guide wall which is disposed in opposed but spaced relation from an end wall of said housing so that the opposed guide and end walls define said passage therebetween.

10. The table according to claim 1, wherein said crank arm has a stop means opposite said outer free end for holding said crank arm slightly upwardly-spaced above said upper surface of said worksurface so as to not contact said upper surface when said crank is in said use position.

11. The table according to claim 10, wherein said crank arm in said use position is inclined relative to said upper surface at an angle between about 3° and about 5°.

12. In an upright freestanding table having a horizontally enlarged worksurface having enlarged upper and lower surfaces, and a pair of leg assemblies fixed to and projecting downwardly from the worksurface adjacent opposite end edges thereof for supportive engagement with a floor, each leg assembly including vertically elongate upper and lower leg members which vertically telescope one within the other, a height-adjusting mechanism extending vertically of and interconnected between the respective upper and lower leg members for permitting selective height adjustment of the upper leg member relative to the lower leg member, and a drive arrangement drivingly connected to the height-adjusting mechanisms of the leg assemblies for permitting simultaneous height adjustment thereof, said drive arrangement including a rotatable driving member disposed adjacent the lower surface of the worksurface and a manually-activated crank arrangement rotatably drivingly connected to said driving member, the improvement wherein said crank arrangement comprises:

a horizontally-elongated recess formed in said worksurface and opening upwardly through the upper surface thereof, said recess defining a pocket at one end thereof which opens downwardly from said upper surface, said recess at the other end defining a passage which extends transversely through the worksurface between the upper and lower surfaces thereof;

a support member rotatably disposed within said pocket for rotation relative to said worksurface about a main axis which extends substantially perpendicularly with respect to said upper surface, means fixed to said worksurface for rotatably supporting said support member so that said support member is positioned in its entirety substantially at and below said upper surface, said support member having a shaft part which projects downwardly along said main axis and is coaxially and nonrotatably connected to said driving member;

a generally L-shaped crank for interconnection to said support member to permit rotation thereof about said main axis, said crank including an elongate crank arm which adjacent an outer free end thereof is provided with a handle fixed thereto and extending transversely therefrom, said handle being adapted to be manually gripped; and pivotal interconnecting means connected between said support member and said crank arm adjacent an inner end thereof for permitting the crank arm to be swingably moved generally within a vertical plane between a storage position and a use position, said L-shaped crank when in said storage position being disposed with the crank arm extending horizontally along and within the recess so that a top surface of the crank arm is substantially flush with said upper surface and said handle projects vertically downwardly through said passage, said L-shaped crank when in said use position being disposed entirely above said upper surface with said crank arm projecting approximately horizontally and radially away from said support member and said handle projecting upwardly from said crank arm.

13. A table according to claim 12, wherein said pivotal interconnecting means includes an intermediate link having a first pivotal connection with the inner end of said crank arm and a second pivotal connection with the support member, said first and second pivotal connections respectively defining first and second substantially horizontally extending pivot axes which are transversely spaced apart in generally parallel relationship.

14. A table according to claim 13, wherein said intermediate link and said crank arm are both disposed within said recess and project horizontally in generally aligned relationship when the L-shaped crank is in said storage position, said intermediate link also being disposed so as to not project upwardly above said upper surface when in said storage position, said intermediate link projecting generally vertically upwardly above said upper surface in generally perpendicular relation thereto when said L-shaped crank is in said use position, and said crank arm projecting approximately horizontally in transverse relationship away from said intermediate link when in said use position, said first pivot axis being respectively disposed below and above the upper surface when the L-shaped crank is in the storage and use positions.

15. The table according to claim 12, wherein said crank arm has a stop means opposite said outer free end for holding said crank arm slightly upwardly-spaced said upper surface of said worksurface so as to not contact said upper surface when said crank is in said use position.

16. The table according to claim 15, wherein a said crank arm in said use position is inclined relative to said upper surface at an angle between about 3° and about 5°.

17. In an upright freestanding table having a horizontally enlarged worksurface having enlarged upper and lower surfaces, and a pair of leg assemblies fixed to and projecting downwardly from the worksurface adjacent opposite end edges thereof for supportive engagement with a floor, each leg assembly including vertically elongate upper and lower leg members which vertically telescope one within the other, a height-adjusting mechanism extending vertically of and interconnected between the respective upper and lower leg members for permitting selective height adjustment of the upper leg member relative to the lower leg member, and a drive arrangement drivingly connected to the height-adjusting mechanisms of the leg assemblies for permitting simultaneous height adjustment thereof, said drive arrangement including a rotatable driving member disposed adjacent the lower surface of the worksurface and a manually-activated crank arrangement rotatably drivingly connected to said driving member, the improvement wherein said crank arrangement comprises:

a horizontally-elongated recess formed in said worksurface and opening upwardly through the upper surface thereof, said recess defining a pocket at one end thereof which opens downwardly from said upper surface;

a support member rotatably disposed within said pocket for rotation relative to said worksurface about a main axis which extends substantially perpendicularly with respect to said upper surface, means fixed to said worksurface for rotatably supporting said support member so that said support member is positioned in its entirety substantially at and below said upper surface, said support member having a shaft part which projects downwardly along said main axis and is coaxially and nonrotatably connected to said driving member;

a crank for interconnection to said support member to permit rotation thereof about said main axis, said crank including an elongate crank arm which adjacent an outer free end thereof is provided with a handle connected thereto, said handle being adapted to be manually gripped; and pivotal interconnecting means connected between said support member and said crank arm adjacent an inner end thereof for permitting the crank arm to be swingably moved generally within a vertical plane between a storage position and a use position, said crank when in said storage position being disposed with the crank arm extending horizontally along and within the recess so that a top surface of the crank arm is substantially flush with said upper surface, said crank when in said use position being disposed entirely above said upper surface with said crank arm projecting approximately horizontally and radially away from said support member and said handle projecting generally upwardly from said crank arm.

18. The table according to claim 17, wherein said pivotal interconnecting means includes an intermediate link having a first pivotal connection with the inner end of said crank arm and a second pivotal connection with said support member, said first and second pivotal connections respectively defining first and second substantially horizontally extending pivot axes which are transversely spaced apart in generally parallel relationship, and wherein said intermediate link is rotatable about said second pivotal connection generally through an angle of about 90° when said crank arm moves from said storage position to said use position and vice versa.

19. The table according to claim 18, wherein said crank arm has a stop means opposite said outer free end for holding said crank arm slightly upwardly-spaced above said upper surface of said worksurface so as to not contact said upper surface when said crank is in said use position.

20. The table according to claim 19, wherein said crank arm in said use position is inclined relative to said upper surface at an angle between about 3° and about 5°.

21. The table according to claim 17, wherein said crank arm rotates around said first pivotal axis generally through an angle between about 85° and about 90° when said crank arm moves from said storage position to said use position and vice versa.

* * * * *